US007507920B2

(12) United States Patent
Erbe

(10) Patent No.: US 7,507,920 B2
(45) Date of Patent: Mar. 24, 2009

(54) HEARING AID WITH A CONTROL ELEMENT

(75) Inventor: Ehrenfried Erbe, Effeltrich (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 386 days.

(21) Appl. No.: 11/353,446

(22) Filed: Feb. 14, 2006

(65) Prior Publication Data

US 2006/0185969 A1 Aug. 24, 2006

(30) Foreign Application Priority Data

Feb. 15, 2005 (DE) ..... 10 2005 006 856

(51) Int. Cl.
*H01H 19/00* (2006.01)
*H01H 19/58* (2006.01)
*H01H 21/00* (2006.01)

(52) U.S. Cl. ..... 200/14

(58) Field of Classification Search ..... 200/14
See application file for complete search history.

(56) References Cited

U.S. PATENT DOCUMENTS 4,354,065 A * 10/1982 Buettner ..... 381/330
4,922,540 A * 5/1990 Erbe ..... 381/324
5,265,168 A * 11/1993 Schiess et al. ..... 381/324
5,463,692 A * 10/1995 Fackler ..... 381/324
7,297,221 B2 * 11/2007 Hikita ..... 156/240
2005/0011065 A1 1/2005 Zhang et al.

FOREIGN PATENT DOCUMENTS

| | | | |
|---|---|---|---|
| DE | 33 36 266 | A1 | 4/1985 |
| DE | 87 08 894 | U | 12/1988 |
| DE | 38 50 322 | T2 | 3/1989 |
| DE | 195 14 360 | C1 | 2/1996 |
| EP | 0 305 213 | A2 | 3/1989 |
| EP | 0 566 354 | A1 | 10/1993 |
| EP | 0 901 262 | A2 | 3/1999 |

* cited by examiner

*Primary Examiner*—Elvin G Enad
*Assistant Examiner*—Lheiren Mae A Anglo

(57) ABSTRACT

In the case of a hearing aid with a movable control element as compact a structure as possible should be achieved and at the same time a large number of movement cycles of the control element should be possible. To this end it is proposed to connect contacts of the movable control element by means of a flexible PCB to the PCB. Preferably the flexible PCB also acts as a support for a flat spring-loaded switch which is activated when the control element performs a swivel movement. Furthermore the flexible PCB has a bending zone which is devoid of electrical contacts and components.

8 Claims, 2 Drawing Sheets

HEARING AID WITH A CONTROL ELEMENT

CROSS REFERENCE TO RELATED APPLICATION

This application claims priority of the German application No. 10 2005 006 856.1 DE filed Feb. 15, 2005, which is incorporated by reference herein in its entirety.

FIELD OF THE INVENTION

The invention relates to a hearing aid with a source transducer to receive an input signal and to convert it into an electrical signal, a signal processing unit to process the electrical input signal and a load transducer to convert the processed electrical input signal into an output signal perceivable by a user, it being possible to adjust the signal processing by means of a user-activated control element.

BACKGROUND OF THE INVENTION

Because of the miniaturization striven for in hearing aids, the space available on a housing of a hearing aid for mounting control elements is severely limited. Hence control elements are also used in hearing aids, it being possible for one control element to perform several operational functions. Normally the control elements are either affixed directly to a PCB or are affixed to the housing of the relevant hearing aid and are connected to a PCB by leads or wires.

From DE 195 14 360 C1, a behind-the-ear hearing aid is known, with an amplifier board and electrical components arranged thereon. For operation the known hearing aid has a so-call MTO switch, a sound level control and a situation switch. Electrical contacts of the control element are contacted to the PCB via leads or wires.

From DE 3336266 A1, a behind-the-ear hearing aid having a partially fixed and partially flexibly designed PCB is known. The PCB has some of the electrical components on a support and has a bending zone devoid of components. Thanks to the flexible PCB the electrical components of the known hearing aid can be accommodated in the housing of the apparatus in a very space-saving manner.

From DE 38 50 322 T2, a hearing aid having a control switch with two operating positions is known, whereby a drive shaft is arranged perpendicular to the housing wall and can be moved between a retracted position near the housing and an extended position, it being possible in the various positions either to change over or to alter the value of a variable resistor.

SUMMARY OF THE INVENTION

The object of this invention is to connect a movable switching element electrically to a PCB in the case of a hearing aid.

This object is achieved by a hearing aid with a source transducer to receive an input signal and convert it into an electrical input signal, a signal processing unit to process the electrical input signal and a load transducer to convert the processed electrical input signal into an output signal that can be perceived by the user, it being possible to adjust the signal processing unit by means of a user-activated control element, the control element having electrical contacts and being capable of being rotated about a first axis and swiveled about a second axis, electrical components of the signal processing unit being arranged on a PCB and a flexible PCB being provided to connect the electrical contacts of the control element and of the PCB.

With the invention a control element is designed to rotate about a first axis and to swivel about a second axis. For example, the control element can be a VC (volume control), with which in addition to the rotational movement the function of a spring-loaded switch can be implemented by applying pressure to the control wheel. For the swivel movement the connection contacts of the control element are likewise swiveled about the swivel axis. If electric conductors in the form of leads or wires are used to electrically connect the control element to the PCB, the problem arises that as a result of the swivel movement the line connection can be damaged. To prevent this, the invention provides for a flexible PCB which is dimensioned and arranged such that it withstands mechanical stress even if the push-button function is activated very frequently. In particular, the flexible PCB has at least one bending zone, in which at least for the most part the bending of the flexible PCB takes place during the swivel movement. This bending zone can then be designed such that even if the control element is subject to very frequent swivel movements, this does not result in any damage to the flexible PCB.

In the case of the invention the flexible PCB preferably includes at least two flanks, the first flank being connected to the electrical contacts of the control element and the second flank to the actual PCB of the hearing aid. The bending zone is preferably situated in the transitional region between the two flanks.

In order to achieve a slim shape for the housing, in particular in the case of a behind-the-ear hearing aid, the first flank of the flexible PCB forms a first plane and the second flank of the flexible PCB a second plane, whereby when the flexible PCB is integrated into the hearing aid the first plane is oriented perpendicular to the second plane.

With the control element according to the invention the swivel movement triggered at the time of activation preferably results in the activation of a miniature spring-loaded switch. In a preferred embodiment of the invention this miniature spring-loaded switch is arranged on the flexible PCB, e.g. on the second flank of the flexible PCB. As a result a particularly space-saving and compact construction of the control element is enabled.

The flexible PCB is connected at one end to the PCB of the amplifier unit of the hearing aid. Preferably the two PCBs form a coherent, one-piece PCB, so that no contacts are required between the PCBs. In this way the PCB of the amplifier unit can likewise be designed so as to be flexible or also fixed. A one-piece PCB reduces the number of components of the hearing aid in question, and thus cuts costs and simplifies assembly.

The flexible PCB present according to the invention can also have at least one other flank besides the first and second flank, resulting in an increase in the area available for placement of components.

In a preferred embodiment of the invention the flexible PCB is designed as a polyamide membrane which includes PCB tracks. The PCB tracks are preferably situated at least in the bending zone not on a surface but inside the flexible PCB, as a result of which the mechanical stress is reduced in the event of bending.

BRIEF DESCRIPTION OF THE DRAWINGS

The invention is explained in more detail below on the basis of an exemplary embodiment. The drawings show.

DETAILED DESCRIPTION OF THE INVENTION

Figure 1:
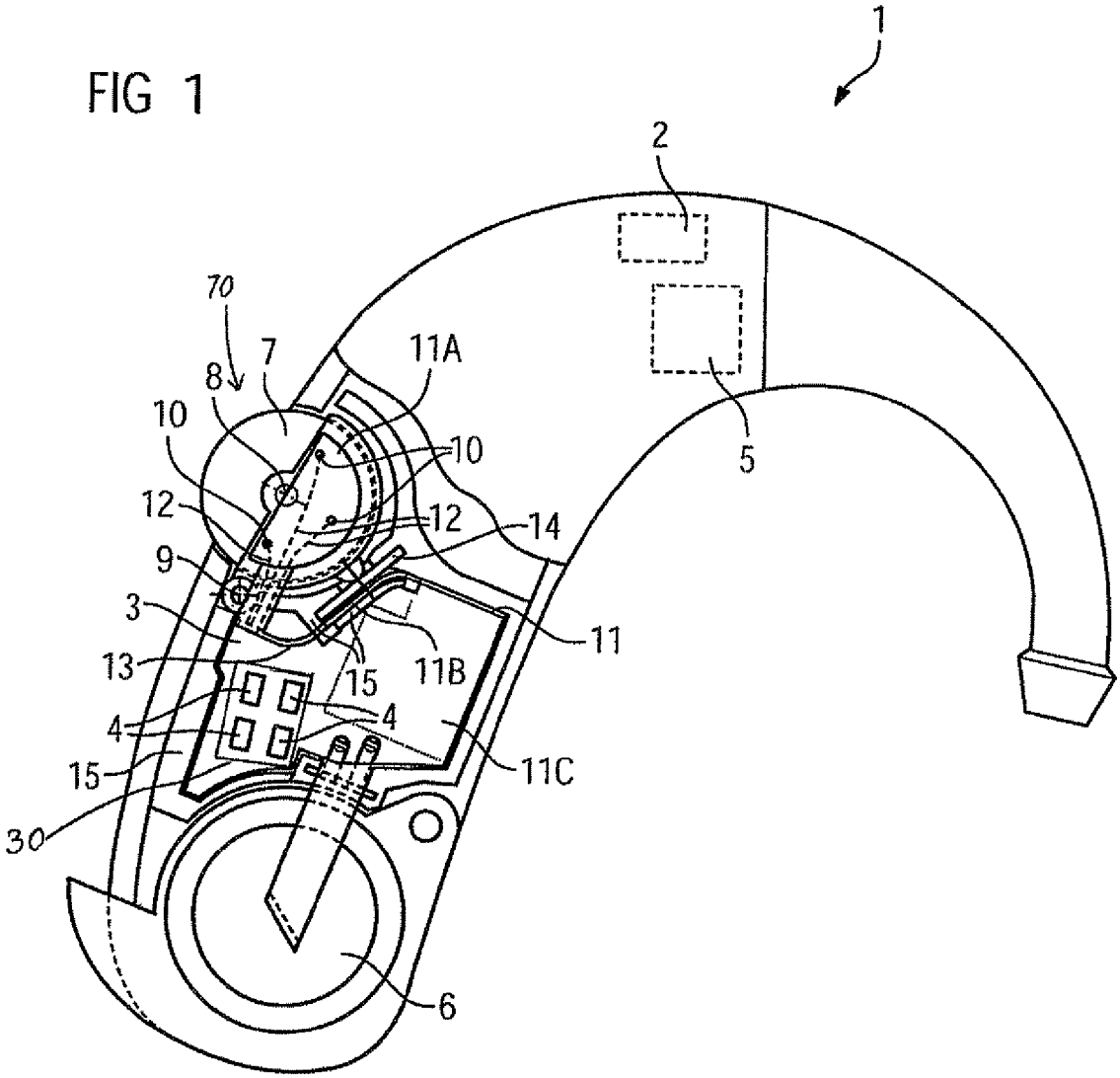
FIG. 1 A behind-the-ear hearing aid 1 with a control element and a flexible PCB 11 according to the invention and FIG. 2 The essential components of the hearing aid 1 in connection with the invention in a perspective view.

FIG. 1 shows a behind-the-ear hearing aid 1 according to the invention. In the housing of the hearing aid 1 is a microphone 2 for receiving an acoustic input signal and converting it into an electrical input signal. The latter is fed to a signal processing unit 30 for further processing and frequency-dependent amplification. The said signal processing unit essentially comprises a fixed PCB 3 and electrical components 4 arranged thereon. The processed and amplified electrical signal is finally converted back into an acoustic signal via an earpiece 5 and is fed to the auditory channel of a user. A battery 6 is provided to supply voltage to electrical components of the hearing aid.

The hearing aid according to the invention further comprises a control element 70 in which a switch-actuating wheel 7 for adjusting the volume is mounted so as to rotate about a first axis 8. Furthermore, by applying pressure to the switch-actuating wheel 7 a swivel movement of the switch-actuating wheel 7 about an axis 9 can be performed. As a result the switch-actuating wheel 7 is also used as a spring-loaded switch, e.g. for changing programs.

To enable as simple as possible a construction for the control element, this has contacts 10 on one side which likewise perform a swivel movement about the axis 9 when pressure is applied to the switch-actuating wheel 7 and which are connected to the PCB 3 via electrical conductors. According to the invention the electrical connection takes place not via wires or leads, but via a flexible PCB 11. In the exemplary embodiment the flexible PCB 11 is subdivided into a first flank 11A, a second flank 11B and a third flank 11C. The first flank 11A forms a plane which runs essentially parallel to the side wall of the hearing aid. Connected to the first flank is a second flank 11B which forms a second plane oriented perpendicular to the first plane. A flat spring-loaded switch 14 is attached and electrically contacted to the second flank 11B. The flexible PCB 11 thus at the same time serves as a support for the flat spring-loaded switch 14. Applying pressure to the switch-actuating wheel 7 and the consequently triggered swivel movement of the switch-actuating wheel 7 results in an activation of the flat spring-loaded switch 14, as a result of which for example a changeover takes place between different hearing programs.

To fix the flexible PCB 11, the PCB 3, the flat spring-loaded switch 14 and the control element, panels 15 are provided, to which the aforementioned electrical hearing aid components are at least partially attached and fixed.

The flexible PCB 11 can also comprise a region which is provided for the placement of electronic components. In the exemplary embodiment the third flank 11C—which is optionally present and hence only shown by dashed lines—of the flexible PCB 11 is indicated, which is arranged parallel to the PCB 3 and at a distance therefrom and which enlarges the PCB surface of the hearing aid 1 on which electronic components can be placed.

In the hearing aid 1 according to the invention the movable control element is electrically connected to the PCB 3 such that a large number of movement cycles can be enabled.

Figure 2:
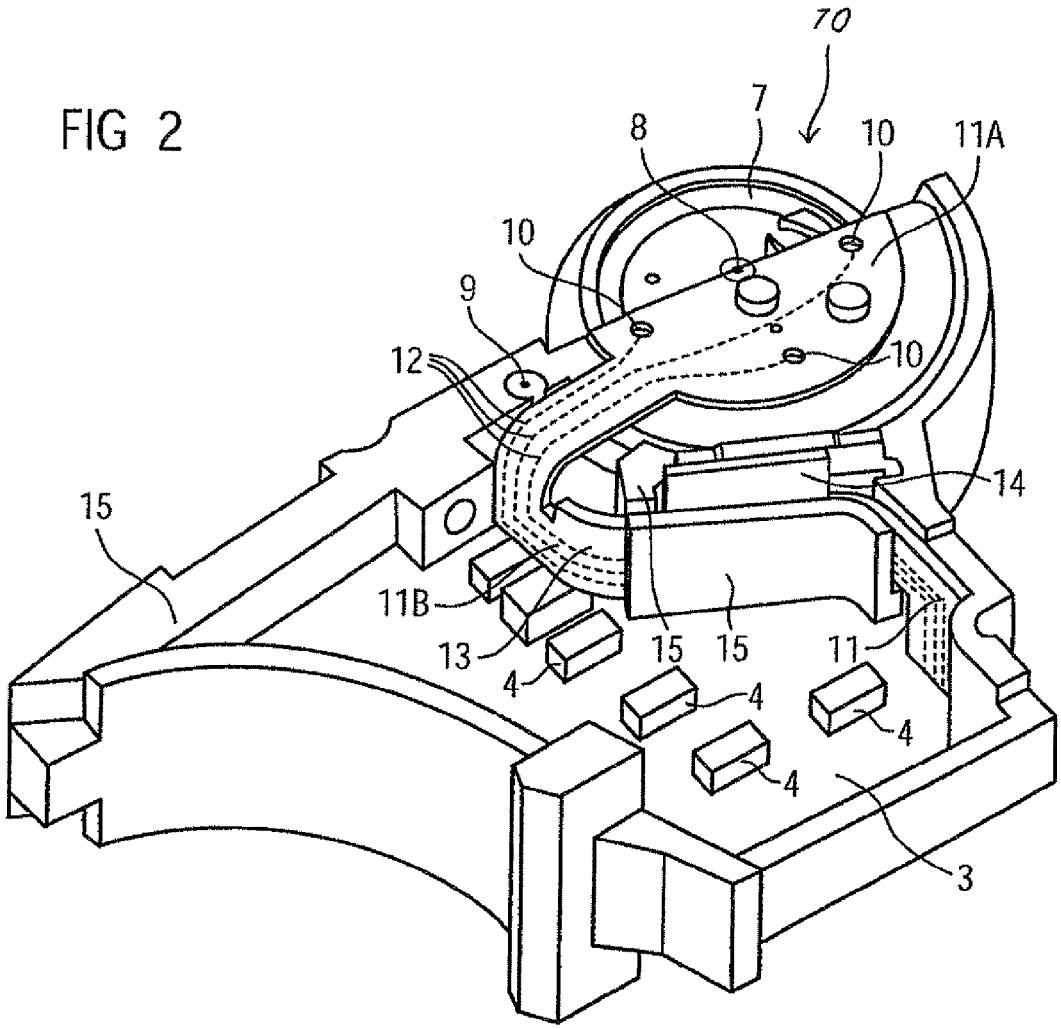

FIG. 2 shows the essential components of the invention in perspective view. A control element with a switch-actuating wheel 7 mounted so as to rotate about an axis 8 is visible. The switch-actuating wheel 7 is further designed so as to swivel about an axis 9. When the user applies pressure to the switch-actuating wheel 7, the control element performs a swivel movement which results in activation of the flat spring-loaded switch 14, as a result of which e.g. a changeover between different programs can be triggered.

The perspective view according to FIG. 2 in particular makes the spatial arrangement of the flexible PCB 11 visible. A first flank 11A of the flexible PCB 11 contacts contacts 10 arranged laterally next to the switch-actuating wheel 7. A second flank 11B of the flexible PCB 11 supports the flat spring-loaded switch 14, which when pressure is applied to the switch-actuating wheel 7 is activated around the swivel axis 9 as a result of the swivel movement. The second flank 11B of the flexible PCB 11 forms a plane which is oriented perpendicular to the plane which forms the first flank 11A. The bending of the flexible PCB 11 takes place predominantly in a bending zone 13 when the control element performs a swivel movement. In the region of the bending zone 13 the flexible PCB 11 is devoid of electrical components or contacts. PCB tracks to electrically connect the contacts 10 to the PCB 3 run on a surface of the flexible PCB 11 or inside the PCB 11. An optional extension of the flexible PCB 11 (see reference character 11C in FIG. 1) is not shown in FIG. 2.

Panels 15 are provided in particular in the region of the flat spring-loaded switch 14 to fix the flexible PCB (11) and also house the fixed PCB 3 with the electrical components 4 arranged thereon.

The invention claimed is:

1. A hearing aid, comprising:

a source transducer to receive an input signal and to convert it into an electrical input signal;

a signal processing unit to process the electrical input signal; and a load transducer to convert the processed electrical input signal into an output signal that can be perceived by a user;

a user-activated control element arranged to adjust the signal processing unit, the control element having electrical contacts and including an activating wheel rotatable about a first axis, the activating wheel further responsive to a pressure force applied by the user to swivel about a second axis;

a plurality of electrical components of the signal processing unit arranged on a PCB; and a flexible PCB arranged to connect at least two of the electrical contacts of the control element and of the PCB in response to at least one of the following: a rotating movement of the wheel about the first axis and a swiveling movement of the wheel about the second axis.

2. The hearing aid according to claim 1, wherein the flexible PCB has at least one bending zone in which the flexible PCB bends when the control element is swiveled about the second axis.

3. The hearing aid according to claim 1, wherein the flexible PCB has at least two flanks such that when the flexible PCB is integrated into the hearing aid the first flank of the flexible PCB forming a plane which is oriented essentially perpendicular to a plane which the second flank forms.

4. The hearing aid according to claim 3, wherein the flexible PCB has at least one further flank on which electrical components are arranged.

5. The hearing aid according to claim 1, wherein the flexible PCB supports a flat spring-loaded switch that is activated by the swivel movement of the control element.

6. The hearing aid according to claim 1, wherein the flexible PCB and the PCB are designed as one piece.

7. The hearing aid according to claim 1, wherein the flexible PCB is designed as a polyamide membrane which includes PCB tracks.

8. The hearing aid according to claim 1, wherein the hearing aid is designed as a behind-the-ear hearing aid.

* * * * *